US005890674A

United States Patent [19]

Major

[11] Patent Number: 5,890,674

[45] Date of Patent: Apr. 6, 1999

[54] INVOLUTE REEL GUIDE

[75] Inventor: Daniel E. Major, Knoxville, Tenn.

[73] Assignee: Formall, Inc., Knoxville, Tenn.

[21] Appl. No.: 7,996

[22] Filed: Jan. 16, 1998

[51] Int. Cl.[6] ..... B65H 75/28; B65H 75/14

[52] U.S. Cl. ..... 242/587; 242/602.2; 242/175.1

[58] Field of Search ..... 242/579, 586, 242/587, 587.1, 587.2, 587.3, 602.2, 175.1, 118.4

[56] References Cited

U.S. PATENT DOCUMENTS

| | | | |
|---|---|---|---|
| 146,675 | 1/1874 | Howell . | |
| 952,227 | 3/1910 | Bangle et al. . | |
| 1,314,658 | 9/1919 | Huber | 242/125.1 |
| 2,272,228 | 2/1942 | Thornburg et al. . | |
| 2,599,926 | 6/1952 | Le Bus | 242/602.2 |
| 2,811,322 | 10/1957 | Wilkinson . | |
| 3,150,844 | 9/1964 | Le Bus, Sr. . | |
| 3,391,879 | 7/1968 | Le Bus | 242/602.2 |
| 3,743,210 | 7/1973 | Hawley . | |
| 4,071,205 | 1/1978 | Wieschel | 242/602.2 |
| 4,387,863 | 6/1983 | Edmonston et al. . | |
| 4,657,203 | 4/1987 | Crawford . | |
| 4,938,432 | 7/1990 | Kurt et al. . | |
| 4,979,687 | 12/1990 | Birch . | |
| 5,246,184 | 9/1993 | Trewhella, Jr. . | |
| 5,593,101 | 1/1997 | Varga . | |

*Primary Examiner*—John M. Jillions
*Attorney, Agent, or Firm*—Luedeka, Neely & Graham, P.C.

[57] ABSTRACT

To provide a spool wrapped length of conductor cable with an exposed cable end at the outer perimeter of a spool flange for the starting wrap of the cable, a cable end guide is secured to the inside face of a spool flange by means of staples or adhesives. The cable end guide provides a supplemental interior flange face having a cable supporting outer edge along a spiral path around the spool hub into substantially tangent alignment with the spool hub. The cable guide may be vacuum formed from thermoplastic sheet into two or more sectors, each sector being physically independent of the others and nestably stackable with corresponding sectors.

13 Claims, 5 Drawing Sheets

INVOLUTE REEL GUIDE

BACKGROUND OF THE INVENTION

The present invention generally relates to spool structures such as are used to wind and transport great lengths of communication and power transmission cable.

Cable is a term used in many industries to describe a rope-like structure that is relatively flexible, has a substantially constant cross sectional shape and an indefinite length. Communications cable may be a fiber optic wave guide within a protective sheath or one or more insulated electrical conductors. Such communication cable is generally produced as a continuous process having a substantially uniform surface texture and circular cross-sectional shape. Since the production is continuous, the length of such cable is determined most often by the length of a manageable quantity, whether in terms of weight or volumetric bulk. Commercial power transmission cable and bundled trunk lines of communication cable are generally wound on large spools of several thousand pounds or more and suitable for handling only by heavy duty power equipment.

The basic construction of an electric conductor or optical wave guide cable spool comprises a substantially cylindrical hub having a surface perimeter that is generally equidistant radially from an elongated hub axis. A convenient axial length of the hub is terminated at opposite axial ends by respective radial flanges. These flanges are generally circular about a center at the hub cylinder axis. The inside or oppositely facing surfaces of these spool flanges generally lie in a plane that is normal to the hub cylinder axis.

One of the characteristics distinctive to the power and communications industries is the need to verify, often frequently, the continuity of cable wrapped upon a transport spool. Hence, physical access to that end of the cable starting the spool wrap is essential. Traditionally, access to the starting end of the cable is assured by securing the starting end to the outer perimeter of one spool flange. From the flange outer edge, the cable lies contiguously with the inner face of the flange along a tangent course with the reel hub perimeter. From tangency with the reel hub, rotational wrapping about the hub begins and progresses along the axial length of the hub to the opposite end flange. Here, the winding cable length begins to overlie those wraps below and proceeds with a second layer of side-by-side wraps progressing along the axial length of the hub back toward the first flange.

This progression continues, layer upon layer, until the desired cable length is wound upon the spool frame. Due to the presence of the cable starting end lying against the inside face of the first flange, a discontinuity is presented along the axial space between the opposite flange faces. This discontinuity allows for one less wrap about the spool hub perimeter along a line between the starting end of the cable and the opposite flange face as compared to the remainder of the hub length between opposite flanges.

One consequence of this hub length discontinuity presented by physical access to the cable starting end is a sliding and often abrasive contact between cable surfaces during the unreeling process as an unwinding wrap slides against the starting end of the cable. Additionally, this discontinuity in the distance between opposing flange faces disrupts the uniform tension and order in the lay of the wrap about the spool hub.

One prior art approach to this wrap discontinuity issue has been to provide a channel in the inside face of one flange to receive the starting cable end. This solution, however, significantly increases the spool construction cost. Another prior art solution has been to secure a layer of inexpensive material against the inside face of the first flange to provide a false inside face for the first flange that includes a protective channel for receipt of the cable starting end. The material substance of such a false face may be soft and inexpensive such as foamed plastic sheet.

A major difficulty with plastic foam sheet for this purpose has been the inability to store the article prior to use in a nested condition. Additionally, such materials generally are somewhat fragile and easily broken.

It is, therefore, an object of the present invention to provide a spiral course reel guide that may be transported and stored in a densely packed, nested condition.

Another object of the invention is provision of a spiral reel guide that is vacuum formed from a single sheet of tough and resilient thermoformed plastic.

SUMMARY OF THE INVENTION

These and other objects of the invention as will subsequently become apparent to those of ordinary skill in the art are served and met by a spiraling reel guide. The guide is assembled from two or more sectors. Each sector is vacuum formed from a single sheet of thermoplastic material. Thickness of the reel guide preferably is about the same as the cable it is intended to support. Such thickness is substantially measured between the inner and outer planes determined by the face surfaces of the reel guide. The face surfaces of the outer plane are positioned contiguously with the inner face of an adjacent spool flange. Between these parallel planes an alternating series of pocket sections are formed. The pocket sidewall depth corresponds to the separation distance between the inner and outer plane surfaces. Transversely, these face sections and pocket sections extend between inside and outside edge surfaces that profile the reel guide radially from the spool hub.

At its interior end, the outside edge surface of the reel guide is preferably located adjacent to and in approximately tangent alignment with the spool hub perimeter. From this point next to the hub perimeter, the outside edge surface spirals outwardly from and around the spool hub out toward the spool flange rim. Preferably, the circular traverse of the spiral is greater than 360° .

The inside edge surface of the reel guide preferably begins at a point of or near convergence with the outside edge surface and follows a circular course over an arc that is preferably less than 360° . At the terminus of the inner edge arc most remote from the region of convergence with the spiraled outer edge, the inner edge of the reel guide turns away from the hub perimeter by a distance preferably at least as great as the cable thickness.

In a preferred embodiment of the invention, the full course of the reel guide structure is separated into two or three independent sectors adapted for lap joints between respective end pockets. As to any individual sector, whether two, three or more, the face and pocket sections are relatively sized and shaped for nested assembly and storage.

In use, the sectors are positioned against the inner face of the selected spool flange with the outer plane surfaces of the reel guide laid contiguously with the inner face surface of the flange. Each reel guide sector is secured by appropriate fastening means which preferably includes staples or adhesive. The circular inside edge of the first sector is aligned in concentricity with the spool hub perimeter. A second sector, also preferably having at least a partially circular inside edge, is also aligned in concentricity with the spool hub perimeter. Additionally, the second sector alignment includes a nested lapping of pockets respective to the adjacent sector ends. A third sector laps the second sector with mutually nesting end pockets. However, the distal end of the third section is positioned for cable clearance between outside edge surface of the first sector and the inside edge surface of that third sector.

An inner or starting end of a continuous cable length is held near the outer perimeter of the spool flange. From the starting end, the cable length is laid against the spiraled outside edge of the reel guide to progress around and inwardly onto the spool hub. Additional cable length is wrapped helically about the spool hub thereby forming a wound cable core. The axial length of the cable core is confined between the outer plane face surfaces of the reel guide and the inner face of the opposite spool flange.

BRIEF DESCRIPTION OF THE DRAWINGS

Other features of the present invention will be more readily understood from the following detailed description of specific embodiments when read in conjunction with the accompanying drawings, in which.

DETAILED DESCRIPTION OF THE INVENTION

Figure 1:
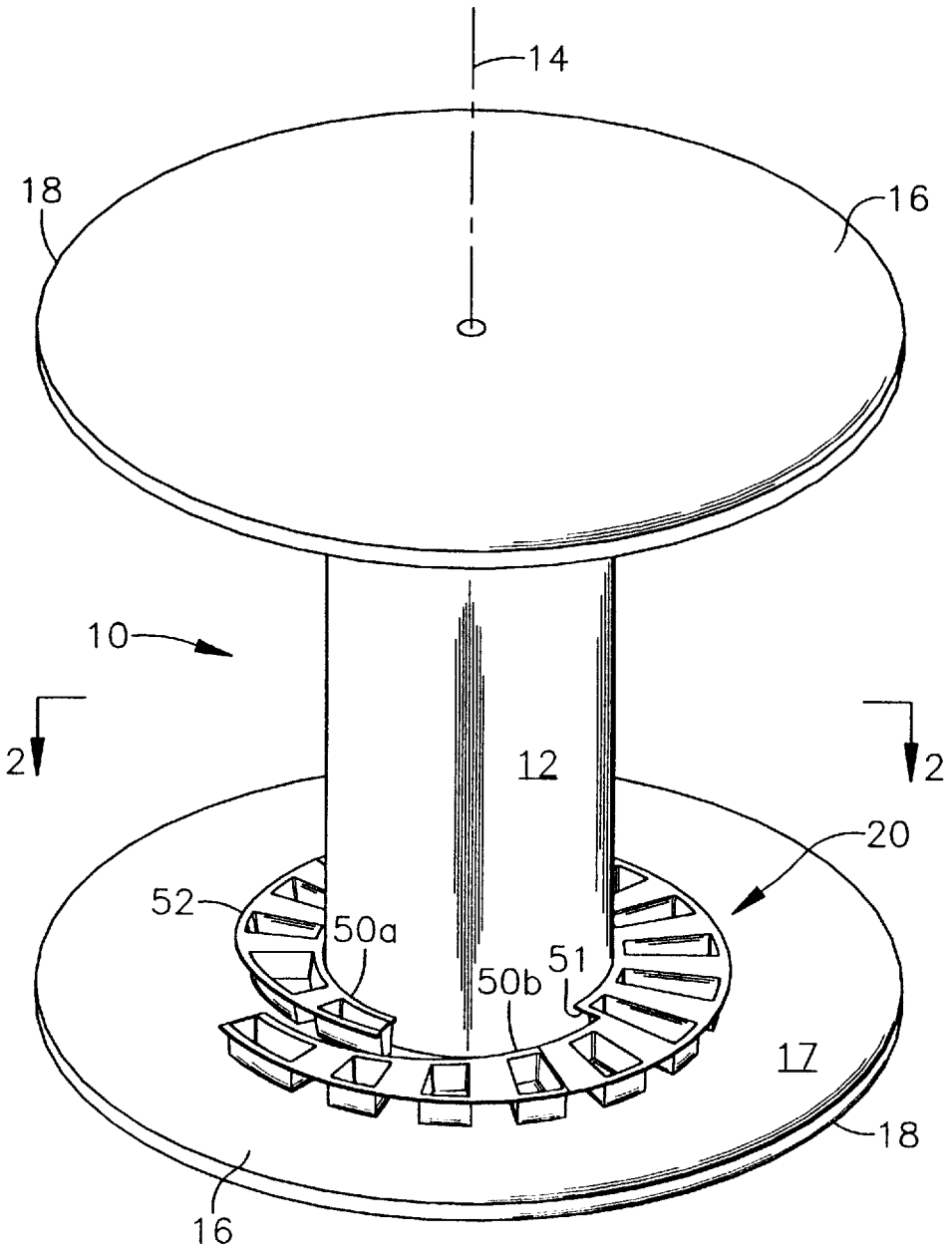
FIG. 1 is a perspective view of a cable spool having the present invention attached thereto.

Referring to the drawings wherein like reference characters designate like or similar elements throughout the several figures of the drawings, the FIG. 1 illustration includes a typical reel spool generally at 10 comprising a hub 12 having spool flanges 16 at opposite axial ends of the hub. Generally, the hub 12 has a cylindrical perimeter developed about an axis 14. Usually, the circular flanges 16 are secured to the hub coaxially about the axis 14. In the present example, the inside faces 17 of the flanges 16 are substantially normal to the hub axis 14. Also, the outer perimeters 18 of the circular flanges 16 are substantially concentric about the hub axis 14. Although the hub 12 is described as a cylinder and the flanges 16 as a circle, it will be understood that numerous regular prism configurations may be used having such cross-sectional geometries as a pentagon, hexagon, octagon, etc.

Figure 2:
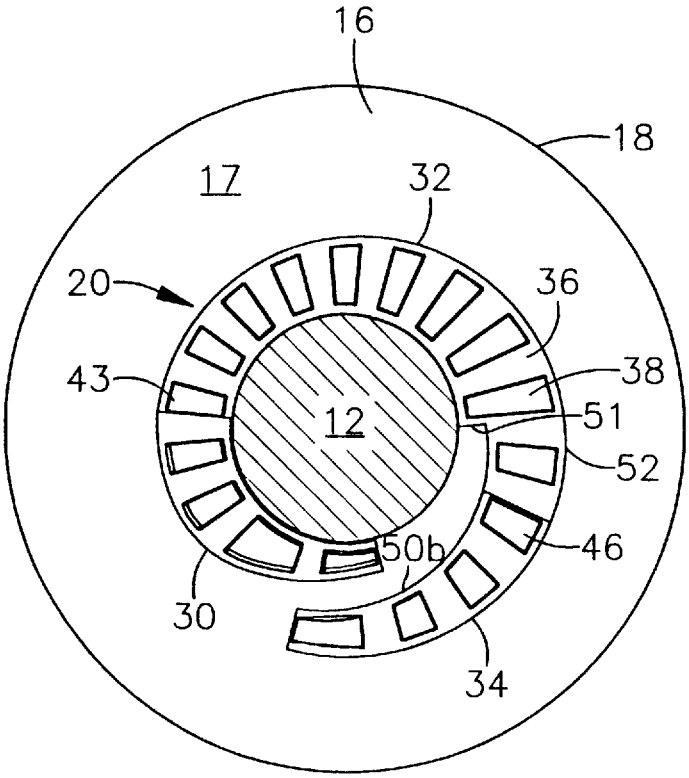
FIG. 2 is a sectional view of the FIG. 1 spool as viewed along the cutting plane 2—2 of FIG. 1;.
Figure 3:
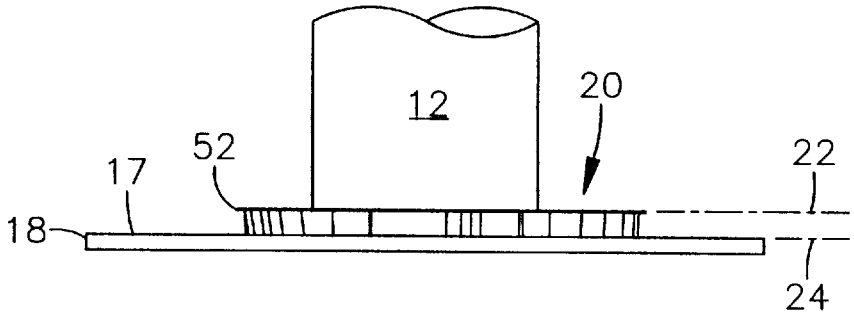
FIG. 3 is front elevational view of the present invention.
Figure 5:
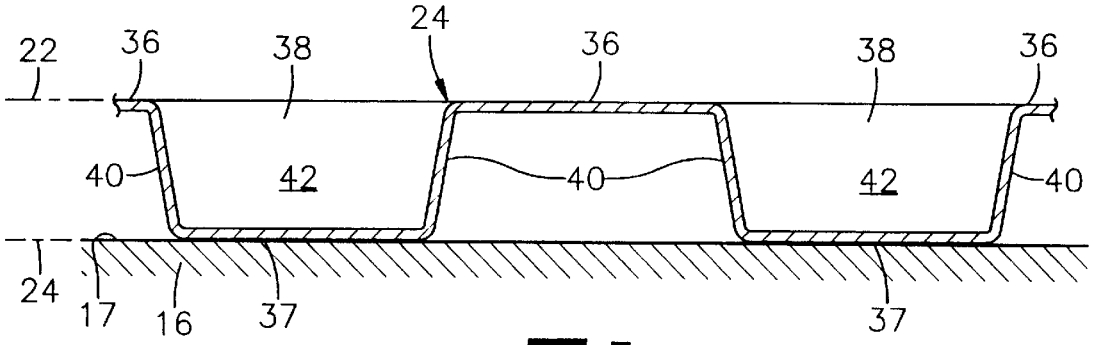
FIG. 5 is a sectional view of the invention as viewed along cutting plane 5—5 of FIG. 4.
Figure 6:
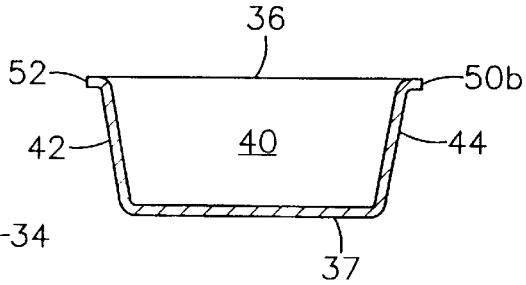
FIG. 6 is a sectional view of the invention as viewed along cutting plane 6—6 of FIG. 4.
Figure 8:
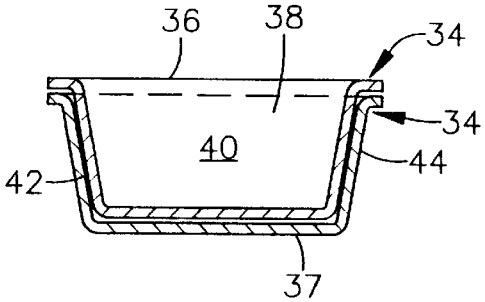
FIG. 8 is a sectional view of a nested assembly of two identical sectors of the invention; and, FIG. 9 is a perspective view of a cable spool having the present invention attached thereto and overlaid by a cable winding.
Figure 7:
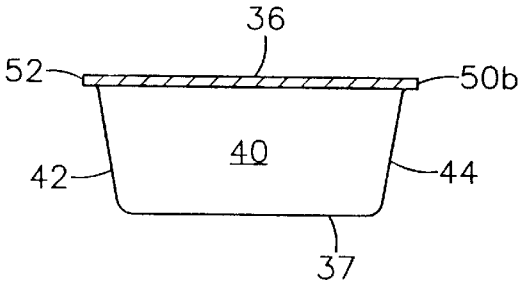
FIG. 7 is a sectional view of the invention as viewed along cutting plane 7—7 of FIG. 4.
Figure 9:
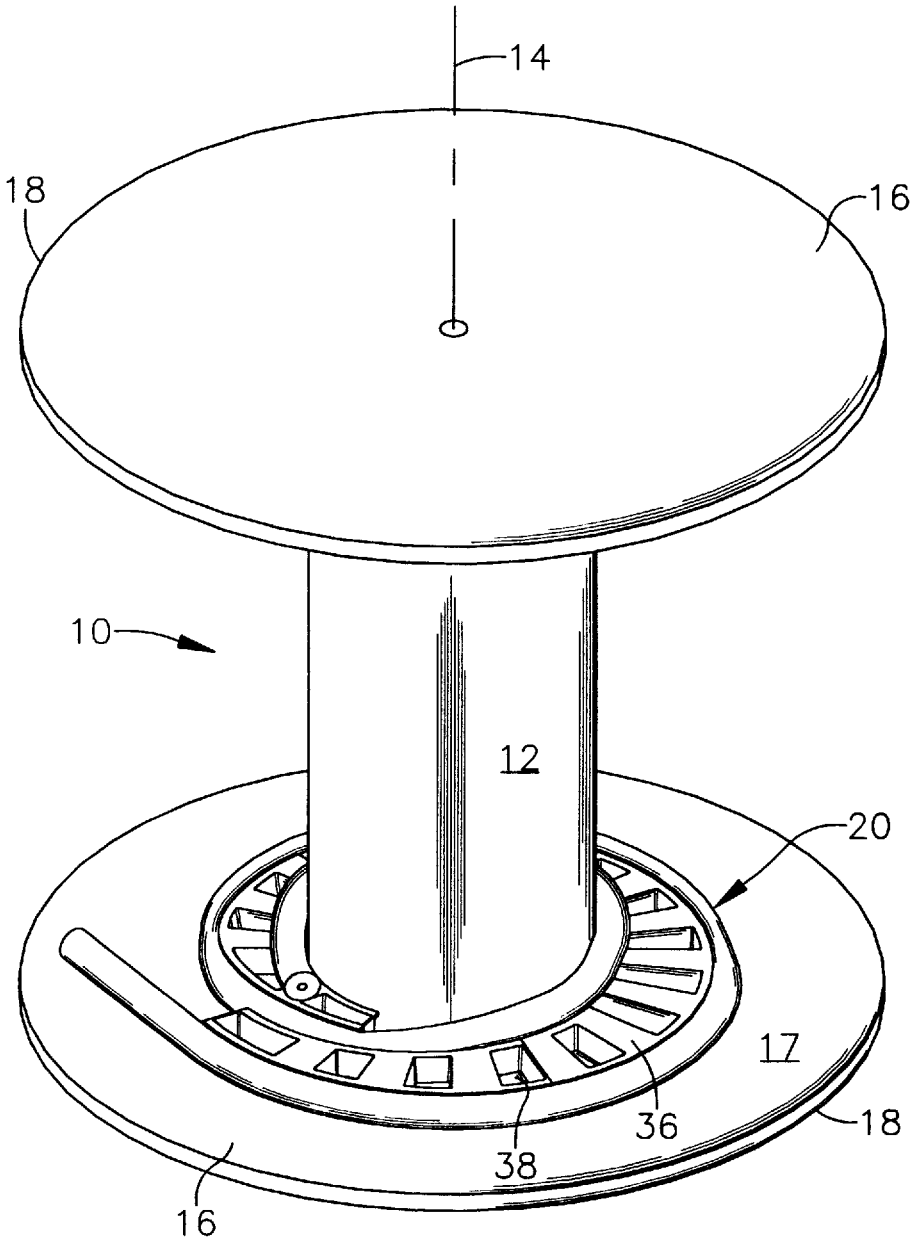

Secured to the inside face 17 of one spool flange 16 is a cable guide 20. This guide is a spiraling structure having a thickness between outer plane 22 and a parallel inner plane 24 illustrated by FIG. 3. In plan as shown by FIG. 2, the outer plane 22 of the cable guide is defined by a series of face sections 36 and pocket sections 38. In the cross-sections of FIGS. 5 and 6, it is seen that the surfaces 37 juxtaposed with the inside spool flange face 17 define the cable guide inner plane 24. The separation distance between these inner and outer cable guide planes 22 and 24 is determined by the height of the pocket walls 40, 42 and 44. Additionally, oppositely facing pocket walls are set at a small divergent angle from the inner plane surface 37 to facilitate a nested vertical stacking of the cable guides as illustrated by FIG. 8.

In the profile of FIG. 2, the cable guide 20 is formed between an inside circumferential edge 50 and an outside circumferential edge 52. Both circumferential edges are material flange extensions of the cable guide face section 36. The inside edge 50 is preferably separated into a circular arc portion 50*a* and an inside spiral portion 50*b*. The circular arc portion 50*a* is preferably developed about a radius that approximates the hub 12 radius. The functional objective of such dimensional approximation is a substantially concentric alignment of the cable guide relative to the hub 12 perimeter. However, the invention is accommodating to a considerable degree of dimensional variation and misalignment.

The circular arc 50*a* of the inside edge also is preferably less than 360° about the hub axis 14. The arcuate opening in the inside edge is determined by the wound cable dimensions and properties. Through this arcuate opening, the cable route transitions from the cable guide onto the hub 12 perimeter surface. Hence, the cable will advance along the hub 12 axial length by a distance corresponding to the cable diameter. The cable stiffness and bending properties will dictate the linear distance required to accommodate the transitional bend.

At the end of the circular arc position 50*a*, the inside circumferential edge transitions at 51 into an inside spiral edge 50*b*. The inside spiral edge preferably continues to the outer end of the cable guide.

The outside circumferential edge 52 of the cable guide begins at the inner end 21 proximate of the hub 12 surface and near to convergence with the inside edge 50*a*. Preferably, the innermost end portions of the outside edge are approximately aligned with a tangent to the hub 12 surface. Such tangential alignment induces a smoothly faired transition of the cable lay from the guide 20 onto the spool hub.

From the cable guide inner end 21, the outside edge 52 follows a spiraling course around the hub 12 in coordinated relation to an increasing radius from the hub axis 14. Preferably, the coordinated relationship is a mathematical function between an angular position of a radius from the axis 14 through a point on the edge 52 and the length of the radius. However, the same mathematical function need not be continuous over the entire course of the outside edge. The spiral rate may be changed over successive angular increments about the axis 14.

The radial extent of the outside edge 52 is preferably determined by the wound cable core thickness. If the objective is to isolate the cable starting end increment that lies between the spool flange rim 18 and the spool hub 12 from the wound cable core, then the outer end of the cable guide may be continued to extend radially from the hub axis 14 at least as far as the cable core.

The outer circumferential edge 52 substantially delineates the outermost plane of the cable guide relative to the thickness of the cable and an off-set of the spool core from the inside face 17 of the spool flange 16. However, the angled circumferential surfaces 42 of the cable guide, as sidewalls of the cable guide pockets 38, provide the structurally contacting support surfaces for the cable. Since it is the inner plane surfaces 37 that are juxtapositionally secured to the inner flange face 17, the divergent angle of the circumferential pocket wall surfaces 42 from the surfaces 37 provides a notched seat for the cable between the pocket wall 42 and the flange face 17. The flanged off-set of the outside circumferential edge 52 from the socket wall 42 compliments the cable seat profile.

Preferably, the full spiral wrap of cable guide 20 is equal to or greater than 360° . In some circumstances, however, this quantity of circular encompassment about the spool hub 12 may be the source of considerable difficulty in positioning a unitary cable guide about the hub 12. In a preferred mode of fabrication, the cable guide is vacuum formed from vinyl polymer sheet of greater than 1/32 in. thickness. Consequently, in dimensions compatible with 2 in. diameter cable and greater, an integral composite of the guide may be extremely stiff.

Responsive to this type of installation difficulty, the cable guide of this invention is adaptable to segmentation. Although two spiral sectors are sufficient to meet most needs, a three sector embodiment as shown by FIG. 4 is preferred.

Figure 4:
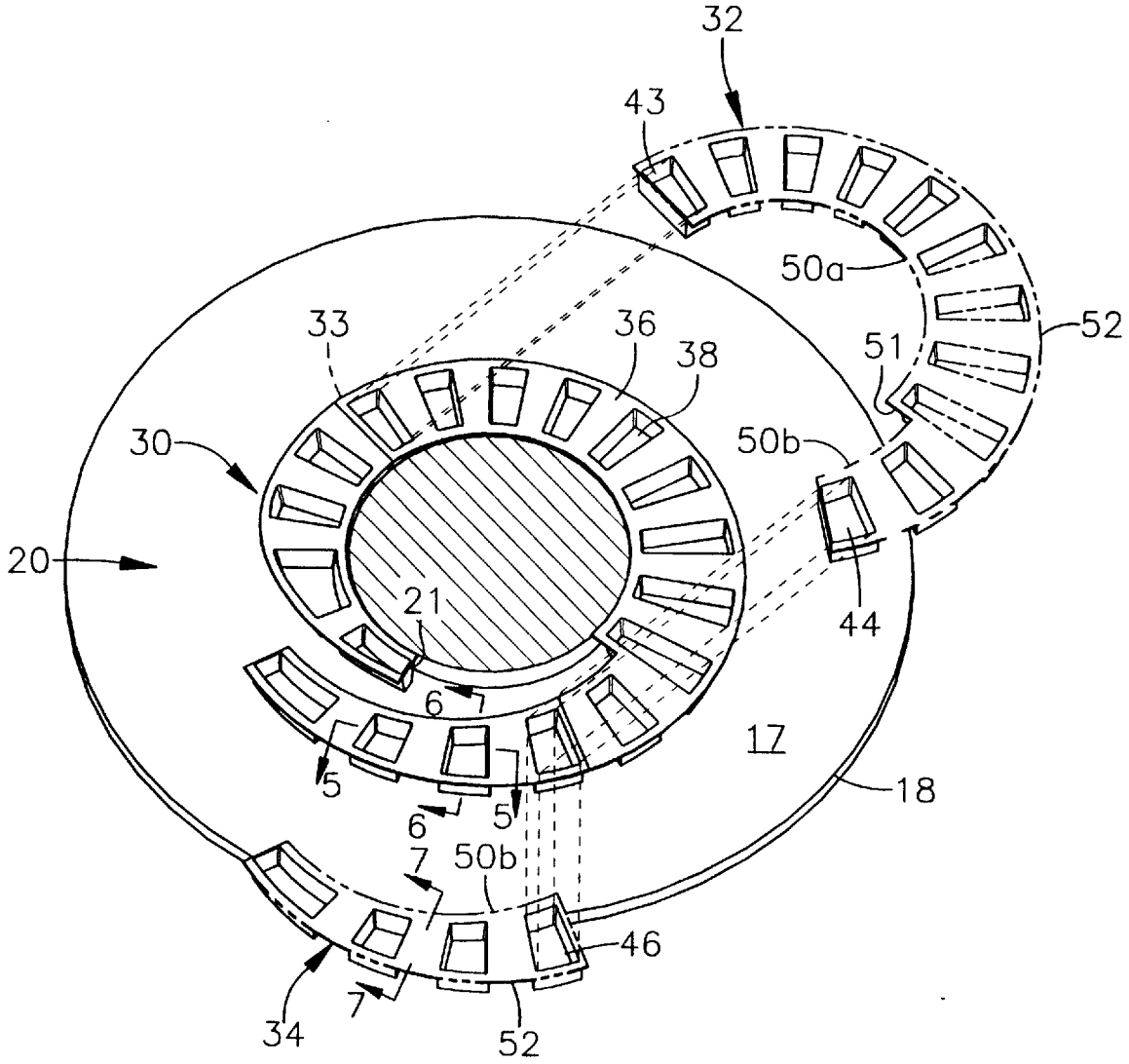
FIG. 4 is an exploded assembly view of a preferred embodiment of the invention.

With respect to the FIG. 4 embodiment, the cable guide 20 is an assembly of an inner sector 30, a middle sector 32 and an outer sector 34. Each of these sectors is an independently fabricated article. Additionally, each sector preferably has a pocket 38 design plan that facilitates nested stacking for storage and shipping.

In particular, an end pocket 33 on the inner sector 30 has a profile that conforms with the end pocket 43 of the middle sector 32. Similarly, the middle sector end pocket 44 has a profile that conforms with the end pocket 46 of the outer sector 34. When attached to the flange face 17, the inner sector 30 is positioned with the inside circumferential edge aligned with the hub 12 perimeter. This position of alignment may be secured by means of adhesive between the surface of flange face 17 and the several cable guide bottom surfaces 37. Alternatively, the inner sector 30 may be secured by means of nails or staples driven through the bottom walls of the several pockets 38.

Next, the middle sector 32 is also positioned next to the flange face 17 and the hub perimeter. Additionally, however, the pocket 43 of middle sector 32 is nested into the end pocket 33 of the inner sector 30. So aligned and positioned, the middle sector 32 is also secured.

Finally, the outer sector 34 is positioned by first nesting the end pocket 46 into the middle sector end pocket 44. Due to material flexure and fit tolerances, the outer end of the outer sector 34 is positioned relative to the inner sector 30 whereby the adjacent outside edge 52 of the inner sector 30 is spaced from the inside edge 50*b* of the outer sector 34 by a distance at least as great as the cable diameter.

The foregoing description of the invention preferred embodiments has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

As my invention, therefore,

What is claimed is:

1. A cable spool appliance for securing a segment of cable adjacent to a spool flange, said appliance comprising:

a structure having an inner edge, an outer edge and a substantially uniform separation thickness between an outer surface plane and an inner surface plane; a portion of said inner edge being an arcuate portion of an approximate circle; said outer edge conforming to a substantial spiral developed about an approximate center of said circle over an arc greater than the arc of said inner edge; at least one of said surface planes comprising an alternating sequence of face sections and pocket sections, said pocket sections having perimeter walls extending substantially between said inner and outer surface planes.

2. A cable spool appliance as described by claim 1 wherein said outer edge is formed to an acute angle between inner and outer surface planes.

3. A cable spool appliance as described by claim 1 wherein said structure is an assembly of at least two adjacent arcuate sectors, said sectors being joined by the nested lap of pocket sections respective to adjacent sectors.

4. A cable spool appliance as described by claim 3 wherein each arcuate sector is configured to nestably assemble with a plurality of corresponding arcuate sectors.

5. A cable spool appliance as described by claim 3 comprising three arcuate sectors, one of said sectors having an inner edge radius greater than an inner edge radius respective to the other two sectors.

6. A cable spool appliance as described by claim 3 wherein each of said sectors are integrally formed from a single sheet of thermoformable material.

7. A cable spool comprising a substantially cylindrical hub terminated at opposite axial ends thereof by substantially circular flanges aligned substantially coaxially with an axis of said hub, radius of said flanges being greater than a radius of said hub, said flanges having opposed, inside faces aligned substantially normal to said hub axis, the inside face of at least one of said flanges having a cable segment guide structure secured thereto about said hub, said guide structure having a first surface plane substantially parallel with and spaced from the inside face of said one flange, said guide structure further comprising a cable supporting edge surface having a width between the inside face of said one flange and said first surface plane and a length that spirals out from a radial perimeter of said hub, said first surface plane comprising an alternating sequence of face sections and pocket sections, said pocket sections being delineated by perimeter walls extending substantially between said first surface plane and the inside face of said one flange.

8. A cable spool as described by claim 7 wherein a planar projection of said cable supporting edge surface intersects said one flange inside face at an acute angle thereby forming a channel between said flange inside face and the first surface plane of said guide structure.

9. A cable spool as described by claim 7 wherein said guide structure comprises an assembly of at least two arcuate sectors, said sectors being joined by a nested lapping of pocket and face sections respective to adjacent sectors.

10. A cable spool as described by claim 9 wherein each arcuate sector is configured to nestably assemble with a plurality of corresponding arcuate sectors in structural isolation from said cable spool.

11. A cable spool as described by claim 9 wherein each of said arcuate sectors are integrally formed from a single sheet of thermoformable material.

12. A cable spool as described by claim 9 comprising three arcuate sectors, two of said sectors having an inside edge substantially conforming to the arc of a partial circle, the partial circle arc edge having a width between said inside face of said one flange and said first surface plane and a length substantially concentric with the radial perimeter of said hub.

13. A cable spool as described by claim 12 wherein the inside edge of a third arcuate sector substantially conforms to a radius greater than said hub radius.

* * * * *